US005913952A

United States Patent [19]

Kim

[11] Patent Number: 5,913,952

[45] Date of Patent: Jun. 22, 1999

[54] METHOD OF BRAKING A DEHYDRATING VESSEL IN A WASHING MACHINE

[75] Inventor: Ji-hyun Kim, Kyonggi-do, Rep. of Korea

[73] Assignee: Samsung Electronics Co., Ltd., Suwon-City, Rep. of Korea

[21] Appl. No.: 09/044,788

[22] Filed: Mar. 20, 1998

[30] Foreign Application Priority Data

Mar. 20, 1997 [KR] Rep. of Korea ..... 97-9590

[51] Int. Cl.[6] ..... D06F 33/02

[52] U.S. Cl. ..... 8/159; 68/12.02; 68/12.12; 68/12.14

[58] Field of Search ..... 8/159; 68/12.02, 68/12.12, 12.14; 210/145, 146; 192/136

[56] References Cited

U.S. PATENT DOCUMENTS 5,824,114 10/1998 Pyo ..... 68/12.02 X

FOREIGN PATENT DOCUMENTS 318994 12/1988 Japan ..... 68/12.14

*Primary Examiner*—Philip R. Coe

*Attorney, Agent, or Firm*—Burns, Doane, Swecker & Mathis, L.L.P.

[57] ABSTRACT

Disclosed is a method of braking a dehydrating vessel in a washing machine which uses a switched reluctance (SR) motor as a rotary power source of the dehydrating vessel, capable of minimizing a noise generated when stopping the SR motor. In a washing machine using the SR motor, it is firstly determined whether the door of the washing machine is opened. As the result of the determination, in the case that the door of the washing machine is opened, the rotating speed of the dehydrating vessel is detected, and then the dehydrating vessel is stopped by varying the duty ratio of the current according to the rotating speed of the dehydrating vessel and then applying the current to the armature coil of the motor.

5 Claims, 4 Drawing Sheets

FIG. 3
PRIOR ART
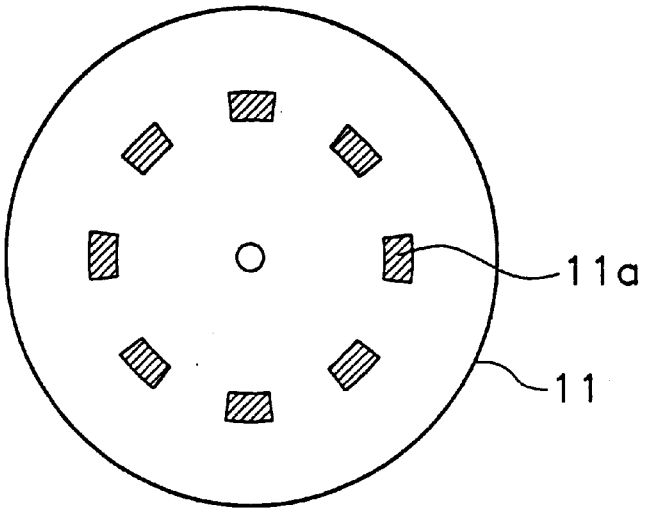
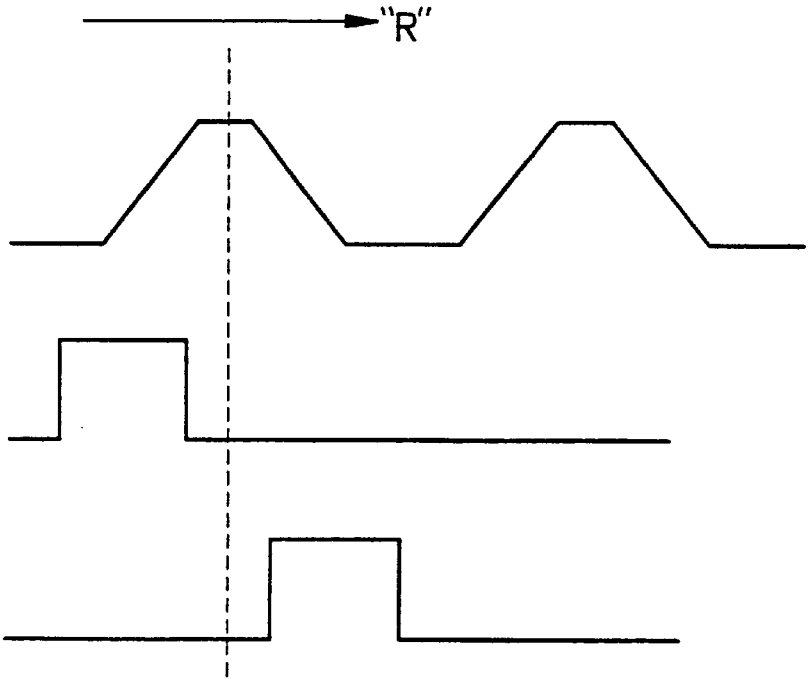
FIG. 4A
PRIOR ART
FIG. 4B
PRIOR ART
FIG. 4C
PRIOR ART

METHOD OF BRAKING A DEHYDRATING VESSEL IN A WASHING MACHINE

BACKGROUND OF THE INVENTION

1. Field of the Invention

The present invention relates to a method of braking a dehydrating vessel in a washing machine which uses a switched reluctance (SR) motor as a rotary power source of the dehydrating vessel, capable of minimizing a noise generated when stopping the SR motor.

2. Description of the Related Art

Generally, a washing machine is one of the electric appliances which cleans laundries by generating a current of water after putting water and detergent into a washing vessel together with the laundries and dehydrates wet laundries which finishes cleaning using the centrifugal separation by rotating the wet laundries which are put in a dehydrating vessel.

The above-described washing machine uses a motor as the rotary power source for rotating the dehydrating vessel. Recently, a washing machine which integrates the washing vessel and the dehydrating vessel and in which the overall washing process is controlled by a microcomputer has been developed. Accordingly, breaking from the level which only supplies the rotary power source for rotating the dehydrating vessel, the motor in which forward rotation/reverse rotation and braking operations are controlled by the microcomputer is preferably used so that the washing performance can be enhanced by creating the current of water effectively.

There are various kinds of motors which satisfy such a requirement. Out of them, as a device for economizing the manufacturing cost, a switched reluctance (SR) motor which satisfies the above-described requirement and is relatively inexpensive has recently been adopted.

FIG. 1 is a view of an embodiment illustrating the inner structure of the conventional SR motor. As shown in the drawing, in the SR motor 10, an armature coil 10*b* binds a core of a stator 10*a* which is arranged around a rotor 10*c* located at the rotary shaft. Accordingly, in the case of electrifying the armature coil 10*b*, a torque is generated by the magnetic attractive force which functions between the rotor 10*c* and the core of the stator 10*a* which is magnetized. By electrifying the armature coils on each A, B and C phase, successively, the rotor 10*c* is rotated. In the drawing, the SR motor 10 having 3 phases which has 6 stators and 4 rotors is disclosed. This SR motor can be manufactured to have multielectrode and polyphase.

FIG. 2 is a view illustrating an operation control circuit for controlling the operation of the SR motor having three phases. The operation control circuit includes inverter unit 20 having pairs of transistors Q1 and Q2; Q3 and Q4; and Q5 and Q6 which apply current to each armature coil La, Lb and Lc of the SR motor 10 from the power source according to the electrifying signal applied to base terminals; current feedback diodes D1 through D6. Pairs of transistors Q1 through Q6 are electrified when the electrifying signal is applied to the their base terminals and electrify the armature coils La, Lb and Lc by applying the current which has the same phase as the electrifying signal and vary the excitation state of the cores of the A, B and C phases, there by controlling the operation of the SR motor 10.

Here, it is important to detect the location of the rotor, as the rotating direction is decided according to the positions of the stator 10*a* and rotor 10*c* when the core of the stator 10*a* is magnetized by electrifying the armature coils La, Lb and Lc of each phase and the rotor 10*c* can be rotated and stopped. Generally, inside of the SR motor 10, as shown in FIG. 3, a sensor plate 11 having a plurality of through holes 11*a* is connected to the rotor 10*c*, and an optical sensor (not illustrated) composed of a light transmitting element and a light receiving element is located facing the through hole 11*a*. As the light transmitted from the light transmitting element is incident upon the light receiving element via the through holes 11*a* of the sensor plate 11, a predetermined detection signal is generated, and thereby the position and the speed of the rotor 10*c* can be detected thereon.

As the electrifying signal to be applied for the operation control circuit is decided according to the position of the detected rotor 10*c*, it is possible to decide the rotating direction of the SR motor 10 or rotate or stop the rotor 10*c*.

FIG. 4A is a view illustrating the shape of an inductance according to the relative positions of a stator and a rotor in the SR motor; FIG. 4B is a view illustrating a wave form of an electrifying signal applied to an armature coil for rotating the SR motor; and FIG. 4C is a view illustrating a wave form of an electrifying signal applied to an armature coil for stopping the SR motor.

As shown in FIG. 4A, as the rotor 10*c* approaches to the core of the A-phase, the inductance increases. When the rotor 10*c* coincides with the core of the A-phase, the inductances reaches at its maximum. As the rotor 10*c* goes apart from the core of the A-phase, the inductance decreases.

As described above, around when the rotor 10*c* and the core of A-phase coincides each other, it is possible to rotate or stop the SR motor 10 according to the point of time when the armature coil of A-phase is electrified. As shown in FIG. 4B, when the rotor 10*c* approaches to the core of A-phase of the stator 10*a*, in the case that the armature coil of A-phase is electrified and the core of A-phase is magnetized, a torque is generated at the rotor 10*c* in the rotating direction due to the magnetic attractive force functioning from the core of the magnetized A-phase.

On the contrary, as shown in FIG. 4C, when the rotor 10*c* goes apart from the core of A-phase of the stator 10*a*, in the case that the armature coil of A-phase is electrified and the core of the A-phase is magnetized, a torque is generated at the rotor 10*c* in the reverse rotating direction due to the magnetic attractive force functioning from the core of the magnetized A-phase. Moreover, assuming that a duty ratio of the current applied to the armature coil is varied, the strength of the torque generated at the rotor can be controlled.

As described above, the microcomputer of the washing machine controls the operation of the SR motor 10 by controlling the phase of the electrifying signal to be applied for the operation control circuit or varying the duty ratio, thereby allowing forward/reverse rotation or stopping the rotor.

The SR motor is relatively inexpensive comparing with another motors. However, it causes a noise when stopping the motor.

Especially, in the case that the door of the washing machine is opened during the dehydrating vessel rotation, it is necessary to stop the dehydrating vessel within a limited short time (it is indicated as 'safety time limit') for user's safety. The safety time limit is prescribed as about 10 seconds. In this case, the microcomputer can stop the dehydrating vessel within the safety time limit by allowing the core of the stator 10*a* to have large magnetic attractive force after applying the current having a large duty ratio to the armature coil. At this time, as the dehydrating vessel which is rotated at a high speed is stopped within in a short time, the noise is generated from the SR motor.

Moreover, in the case that the dehydrating vessel is rotated at a low speed, the microcomputer stops the dehydrating vessel by applying the current having the same duty ratio as when the dehydrating vessel is rotated at a high speed to the armature coil. At this time, the time for stopping the dehydrating vessel rotating at a low speed becomes shorter than the dehydrating vessel which is rotated at a high speed. However, the degree of the noise is the same as when stopping the dehydrating vessel which is rotated at a high speed.

SUMMARY OF THE INVENTION

Therefore, it is an object of the present invention to minimize a noise by braking a dehydrating vessel within a safety time limit and allowing the braking time to be approximated to the safety time limit, by varying the duty ratio of a current according to the rotating speed of the dehydrating vessel and then applying the current to an armature coil.

To achieve the above object, in a washing machine using a switched reluctance (SR) motor according to the present invention, it is firstly determined whether the door of the washing machine is opened. As the result of the determination, in the case that the door of the washing machine is opened, the rotating speed of the dehydrating vessel is detected, and then the dehydrating vessel is stopped by varying the duty ratio of the current according to the rotating speed of the dehydrating vessel and then applying the current to the armature coil of the motor.

Preferably, the duty ratio of the current varies in proportion to the rotating speed.

BRIEF DESCRIPTION OF THE DRAWINGS

A more complete appreciation of the present invention, and may of the attendant advantages thereof, will become readily apparent as the same becomes better understood by reference to the following detailed description when considered in conjunction with the accompanying drawings in which like reference symbols indicate the same or similar components, wherein:

FIG. 3 is a view illustrating a sensor plate which is connected to a rotor of the SR motor;

FIG. 4A is a view illustrating the shape of an inductance according to the relative positions of a stator and a rotor in the SR motor;

FIG. 4B is a view illustrating a wave form of an electrifying signal applied to an armature coil for rotating the SR motor;

FIG. 4C is a view illustrating a wave form of an electrifying signal applied to an armature coil for stopping the SR motor;

DETAILED DESCRIPTION OF THE PREFERRED EMBODIMENTS

The objects, characteristics and advantages of the above-described invention will be more clearly understood through the preferable embodiments referring to the attached drawings.

Figure 1:
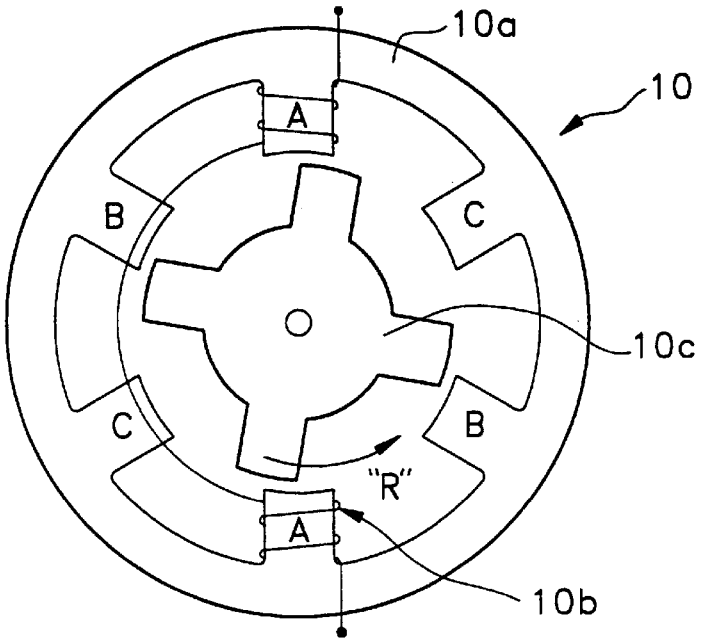
FIG. 1 PRIOR ART
FIG. 1 is a cross sectional view illustrating the inner structure of a conventional switched reluctance (SR) motor.
Figure 2:
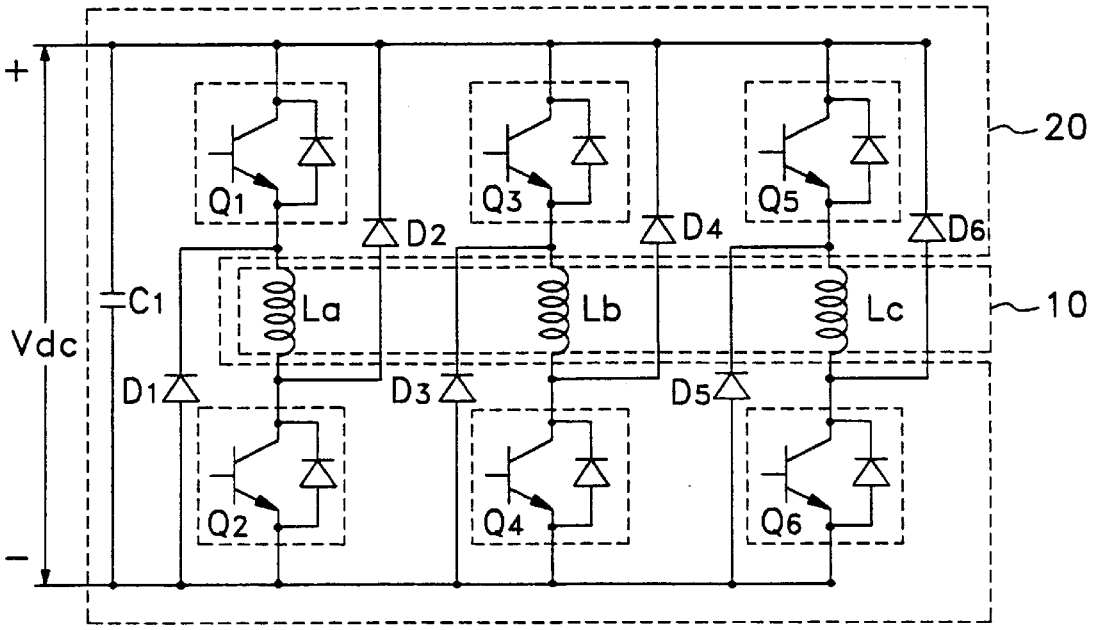
FIG. 2 PRIOR ART
FIG. 2 is a view illustrating an operation control circuit for controlling the operation of the convention SR motor.
Figure 5:
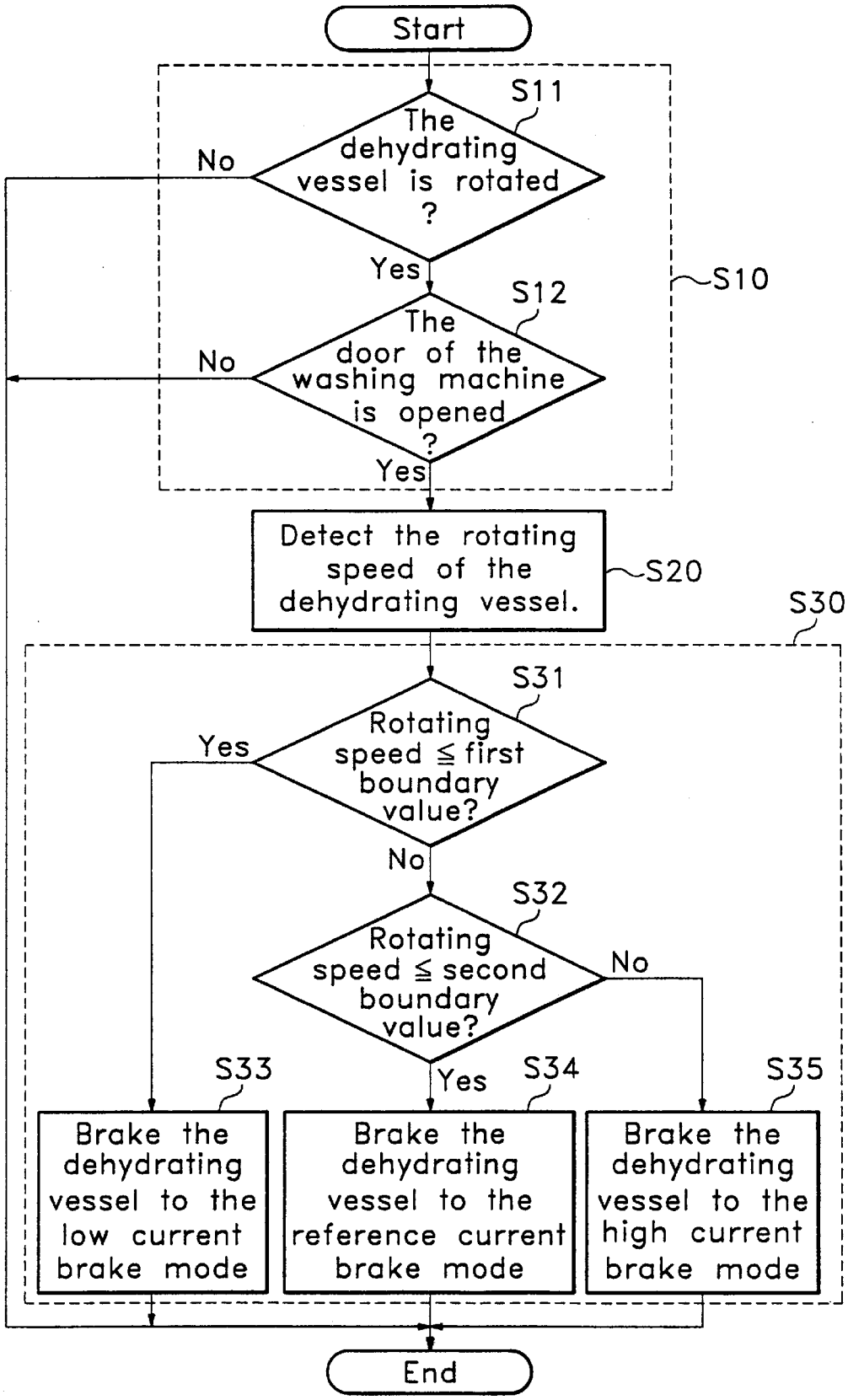
FIG. 5 is a flowchart illustrating the order of a method for braking a dehydrating vessel in a washing machine according to the present invention.
Figure 6:
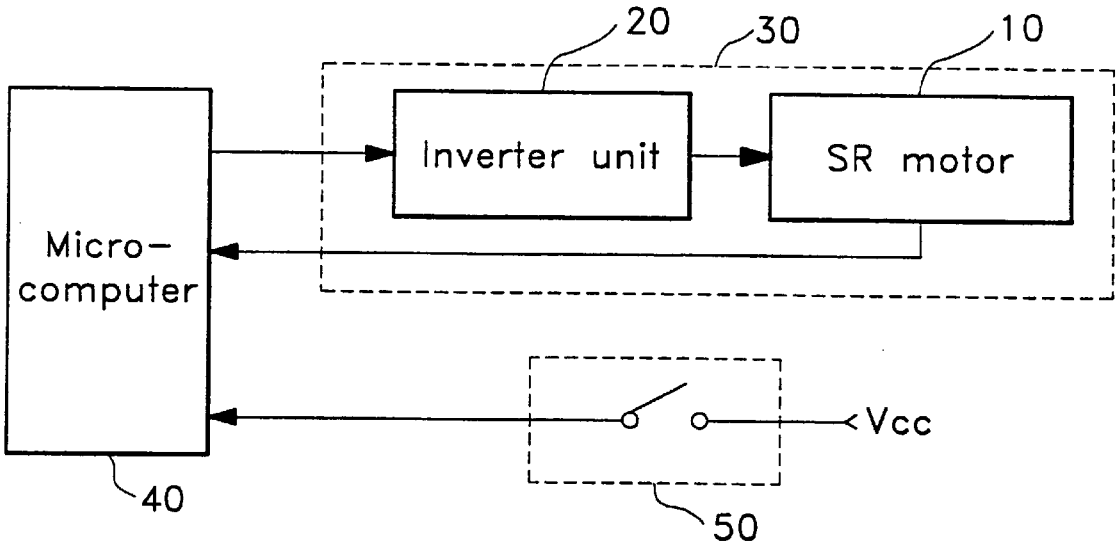
FIG. 6 is a block circuit diagram for controlling the operation of the SR motor in the washing machine to which a method for braking the dehydrating vessel according to the present invention is applied.

FIG. 5 is a flowchart illustrating the order of a method for braking a dehydrating vessel of a washing machine according to the present invention; and FIG. 6 is a block circuit diagram for controlling the operation of the SR motor 10 in the washing machine to which a method for braking the dehydrating vessel according to the present invention is applied.

Referring to FIG. 5, the method for braking the dehydrating vessel according to the present invention includes the steps of: determining whether the door of the washing machine is opened during the dehydrating vessel rotation (step 10); detecting the rotating speed of the dehydrating vessel in the case that it is determined that the door is opened as a result of the determination (step 20); and stopping the dehydrating vessel to a relevant brake mode after comparing the detected rotating speed of the dehydrating vessel with a predetermined reference value (step 30).

Here, as shown in FIG. 6, the fact whether the door is opened or not is sensed by a door switch 50 which is controlled by the opening/closing operation of the door of the washing machine. The rotating speed of the dehydrating vessel is detected by a signal outputted from an optical sensor which is located inside of the SR motor 10 to detect the position of the rotor.

Moreover, the reference value includes first and second boundary values for classifying each low, middle and high speed. When comparing the first and second boundary values, in the case that the rotating speed is below the first boundary value, the dehydrating vessel is stopped to a low current brake mode. In the case that the rotating speed is over the first boundary value and lower than the second boundary value, the dehydrating vessel is stopped to a reference current brake mode. In addition, in the case of the rotating speed is over the second boundary value, the dehydrating vessel is stopped to the high current brake mode.

After that, the time for braking the dehydrating vessel is controlled by differently setting the duty ratio of the current which is applied to the armature coil of the SR motor 10 according to the respective brake modes and then controlling the amount of energy applied to the coil. At this time, the duty ratio of the current according to the brake modes is set in proportion to the rotating speed defined at each brake mode. Moreover, it is preferable to set the value so that the dehydrating vessel is stopped within the safety time limit and the time for braking the dehydrating vessel approximates to the safety time limit at its maximum.

The operation of the washing machine using the above-described method of braking the dehydrating vessel is explained referring to the attached drawings. When the dehydrating vessel is rotated to dehydrate laundries which finish cleaning, the microcomputer 40 senses whether the door of the washing machine is opened or not through the on/off state of the door switch 50. At this time, in the case that the door of the washing machine is opened, the door switch 50 is turned on, thereby generating a sensing signal to the microcomputer 40 (steps 11 and 12).

When the sensing signal is generated by the door switch 50, the microcomputer 40 recognizes that the door of the washing machine is opened, and detects the rotating speed of the dehydrating vessel through a signal generated from the optical sensor located inside of the SR motor 10 (step 20).

After the rotating speed is detected, it is tested whether the rotating speed belongs to the low speed region by comparing the rotating speed with the first boundary value. In the case that the result satisfies the condition, the dehydrating vessel is stopped to the low current brake mode (steps 31 and 33).

Moreover, when the rotating speed is larger than the first boundary value, the speed is compared with the preset second boundary value and tested whether the rotating speed belongs to the middle speed region. In the case that the result satisfies the condition, the dehydrating vessel is stopped to the reference current brake mode (steps 32 and 34). In addition, the rotating speed is larger than the second boundary value, it is determined that the rotating speed belongs to the high speed region and the dehydrating vessel is stopped to the high current brake mode (step 35).

The microcomputer 40 compares the rotating speed with the first and second boundary values and applies the current each having a different duty ratio to the armature coil of the SR motor 10 according to the decided brake mode, thereby stopping the rotating dehydrating vessel.

At this time, the microcomputer 40 applies the electrifying signal having a predetermined duty ratio decided according to the brake modes to the operation control signal 30. The pairs of transistors (not illustrated) forming the inverter unit 20 of the operation control circuit 30 are turned on according to the electrifying signal. After that, the current having the same phase as the electrifying signal is applied to the armature coil of the SR motor 10, and thereby the rotor of the SR motor 10 is stopped by the magnetic attractive force.

Here, the microcomputer 40 detects the position of the rotor based on the detection signal generated from the optical sensor inside of the SR motor 10, and controls the phase of the electrifying signal for controlling the power supply to each armature coil of the SR motor 10, thereby stopping the dehydrating vessel.

By stopping the dehydrating vessel so that the time for braking the dehydrating vessel can approximate to the safety time limit even in the different rotating speed, the current having the same duty ratio as when the rotating speed is high is applied to the armature coil, and thereby the degree of the noise can be reduced than stopping the dehydrating vessel.

As described above, according to the present invention, by varying the duty ratio of the current according to the rotating speed of the dehydrating vessel and then applying the current to the armature coil, the dehydrating vessel is stopped so that the braking time can approximate to the safety time limit at its maximum even in the different rotating speed.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A method of braking a dehydrating vessel of a washing machine using a switched reluctance (SR) motor, comprising the steps of:

determining whether the door of the washing machine is opened during rotation of the dehydrating vessel;

detecting the rotating speed of said dehydrating vessel, in the case that the door of said washing machine is opened; and braking said dehydrating vessel by varying the duty ratio of a current according to said detected rotating speed and then applying the current to an armature coil of said motor.

2. The method of claim 1, wherein the duty ratio of said current is varied in proportion to said rotating speed.

3. The method of claim 1, wherein the step of braking said dehydrating vessel comprises the steps of:

comparing said detected rotating speed with a predetermined reference value; and applying the current having the varied duty ratio according to the compared result.

4. The method of claim 3, wherein said reference value comprises:

a first boundary value which defines the boundary between a low speed and a middle speed; and a second boundary value which defines the boundary between said middle speed and a high speed.

5. The method of claim 4, comprising the steps of:

braking said dehydrating vessel by applying a low current to the armature coil of said motor, in the case that said detected rotating speed is lower than said first boundary value;

braking said dehydrating vessel by applying a reference current to the armature coil of said motor, in the case that said detected rotating speed is between said first boundary value and said second boundary value; and braking said dehydrating vessel by applying a high current to the armature coil of said motor, in the case that said detected rotating speed is larger than said second boundary value.

* * * * *